US005503094A

United States Patent [19]

Tseng

[11] Patent Number: 5,503,094

[45] Date of Patent: Apr. 2, 1996

[54] NEEDLE PLATE WITH MOVABLE TONGUES FOR SEWING MACHINE

[76] Inventor: Hsien-Chang Tseng, No. 206-7, Section 1, Guo Guang Road, Da Li City, Taichung Hsien, Taiwan

[21] Appl. No.: 394,969

[22] Filed: Feb. 27, 1995

[51] Int. Cl.[6] ..... D05B 73/12

[52] U.S. Cl. ..... 112/260; 112/165

[58] Field of Search ..... 112/260, 197, 112/165, 235

[56] References Cited

U.S. PATENT DOCUMENTS

| | | | |
|---|---|---|---|
| 1,795,373 | 3/1931 | Maier | 112/260 |
| 4,356,782 | 11/1982 | Ueyama et al. | 112/197 |
| 5,123,365 | 6/1992 | Ichimura | 112/165 |
| 5,398,627 | 3/1995 | Nishikawa | 112/165 X |

FOREIGN PATENT DOCUMENTS

| | | | |
|---|---|---|---|
| 1249495 | 11/1986 | Japan | 112/235 |

*Primary Examiner*—Ismael Izaguirre
*Attorney, Agent, or Firm*—Charles E. Baxley

[57] ABSTRACT

A needle plate for a sewing machine includes an opening formed in one side portion. On or more tongues may be secured to the needle plate and extended inward of the opening so as to conduct various kinds of sewing operations. A bracket is secured to the needle plate and includes a channel. A lever is slidably engaged in the channel and includes another tongue movable away from the previous tongue and movable toward the position located beside the previous tongue so as to form another tongue.

7 Claims, 3 Drawing Sheets

NEEDLE PLATE WITH MOVABLE TONGUES FOR SEWING MACHINE

BACKGROUND OF THE INVENTION

1. Field of the Invention

The present invention relates to a needle plate, and more particularly to a needle plate assembly for sewing machine.

2. Description of the Prior Art

Typical needle plates of overlock sewing machine comprise a needle plate disposed below and cooperating with the needles and presser foot so as to conduct sewing operations, such as narrow hem, rolled hem and regular overlock edge hem. In order to conduct such operations, a number of needle plates should be provided and each includes a tongue of different size or of different shape. Accordingly, a number of tongues are required for conducting sewing operations. In addition, it is required to disengage the needle plate and to mount another needle plate onto the sewing machine when it is required to conduct different sewing operations.

The present invention has arisen to mitigate and/or obviate the afore-described disadvantages of the conventional needle plates of sewing machines.

SUMMARY OF THE INVENTION

The primary objective of the present invention is to provide a needle plate assembly which includes a slidable tongue movable to engage with another tongue so as to form a further tongue.

The other objective of the present invention is to provide a needle plate assembly which includes a number of tongues that may be easily secured to the needle plates without disengaging the needle plates from the sewing machine.

In accordance with one aspect of the invention, there is provided a needle plate assembly for a sewing machine comprising a needle plate including an opening formed therein and including at least one first tongue, a bracket secured to the needle plate and including a channel provided therein, and a lever slidably engaged in the channel and including a first end having a second tongue formed thereon, the second tongue being moved to a position located beside the first tongue so as to form another tongue.

The channel includes a side wall having a notch formed therein, the lever includes a projection extended outward through the notch for moving the lever and for moving the second tongue toward or away from the first tongue.

The bracket further includes a biasing means for biasing the lever and for resiliently retaining the lever in place.

The channel includes a depression formed therein, the bracket further includes a V-shaped spring having a middle portion engaged in the depression, the spring biases the lever for resiliently retaining the lever in place.

The first tongue may be manufactured individually and may be secured to the needle plate.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
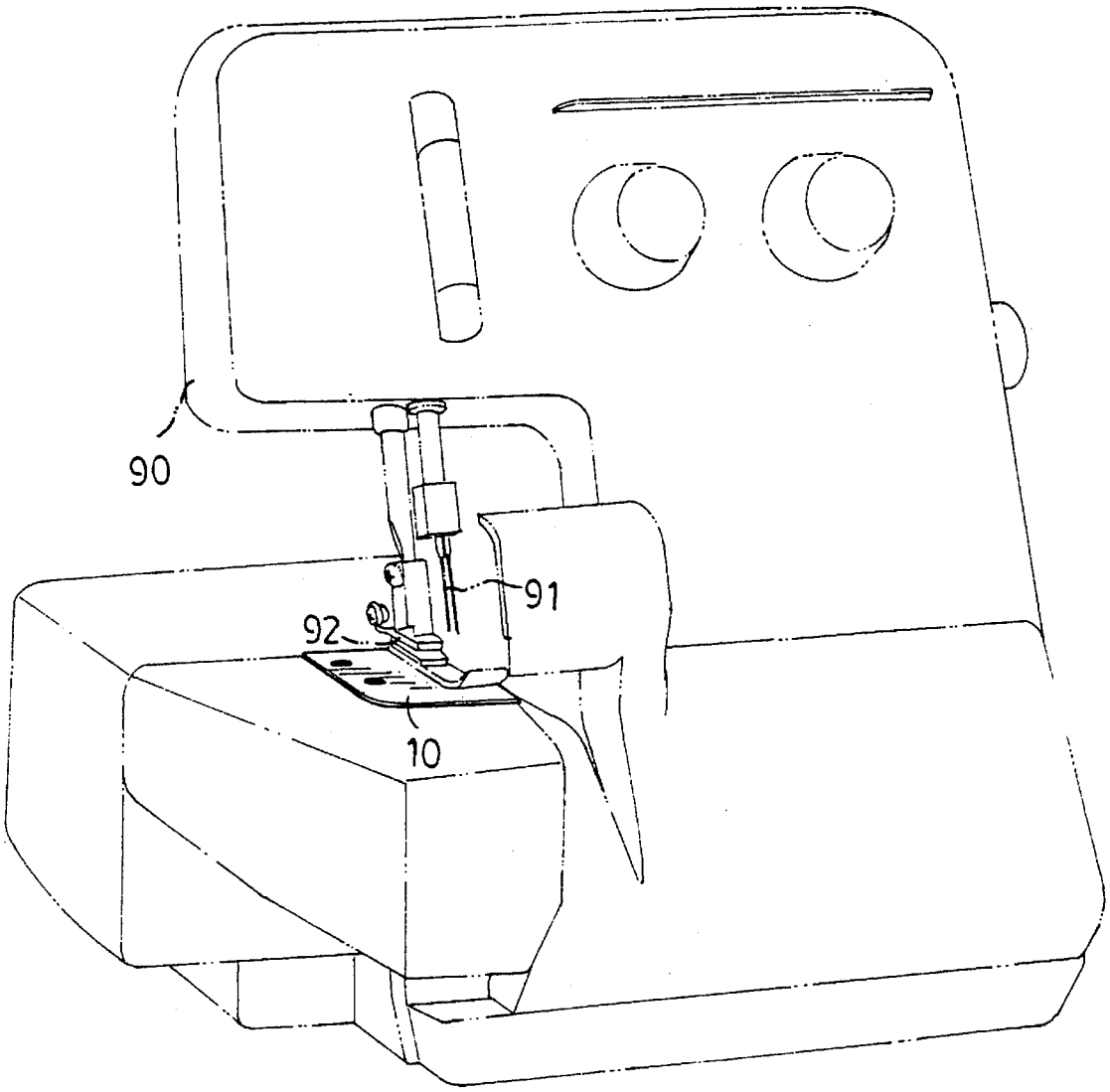
FIG. 1 is a perspective view illustrating the application of the needle plate assembly in accordance with the present invention.

Referring to the drawings, and initially to FIG. 1, a needle plate assembly 10 in accordance with the present invention is arranged below the needles 91 and the presser foot 92 of a sewing machine 90 for conducting sewing operations with the needles 91.

Figure 3:
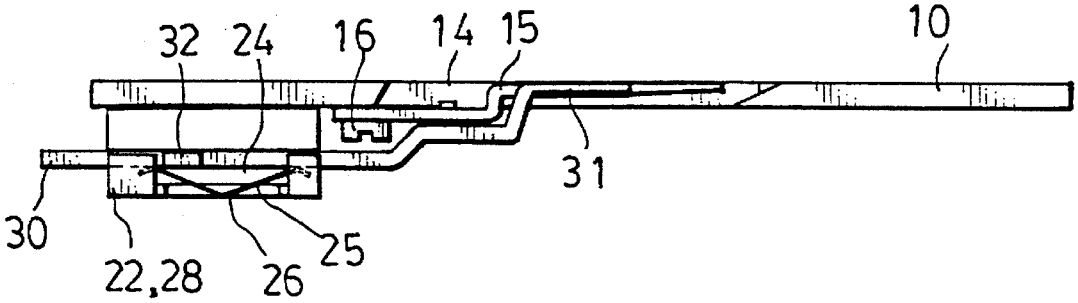
FIG. 3 is an end view of the needle plate assembly.
Figure 2:
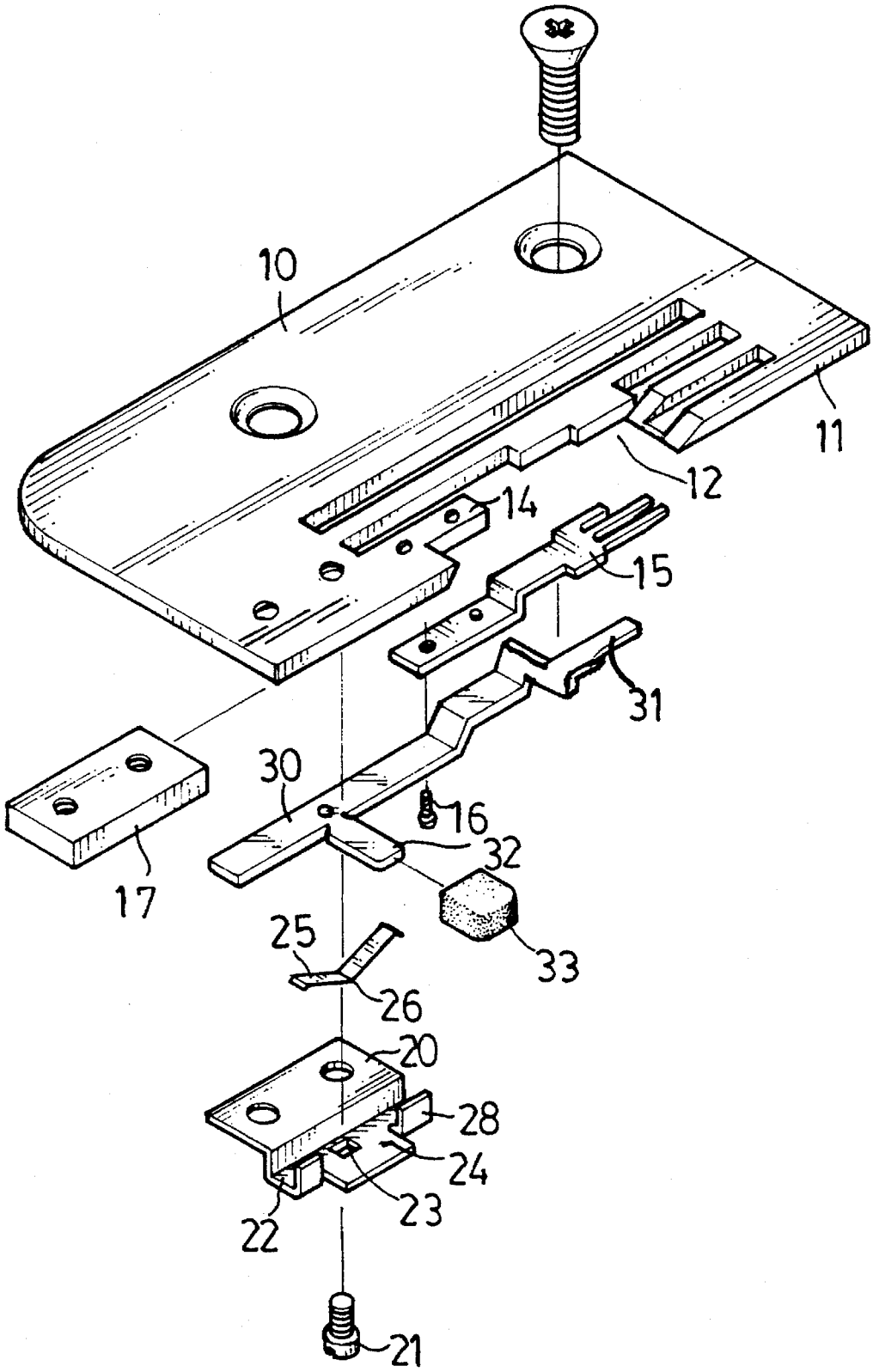
FIG. 2 is an exploded view of the needle plate assembly.
Figure 4:
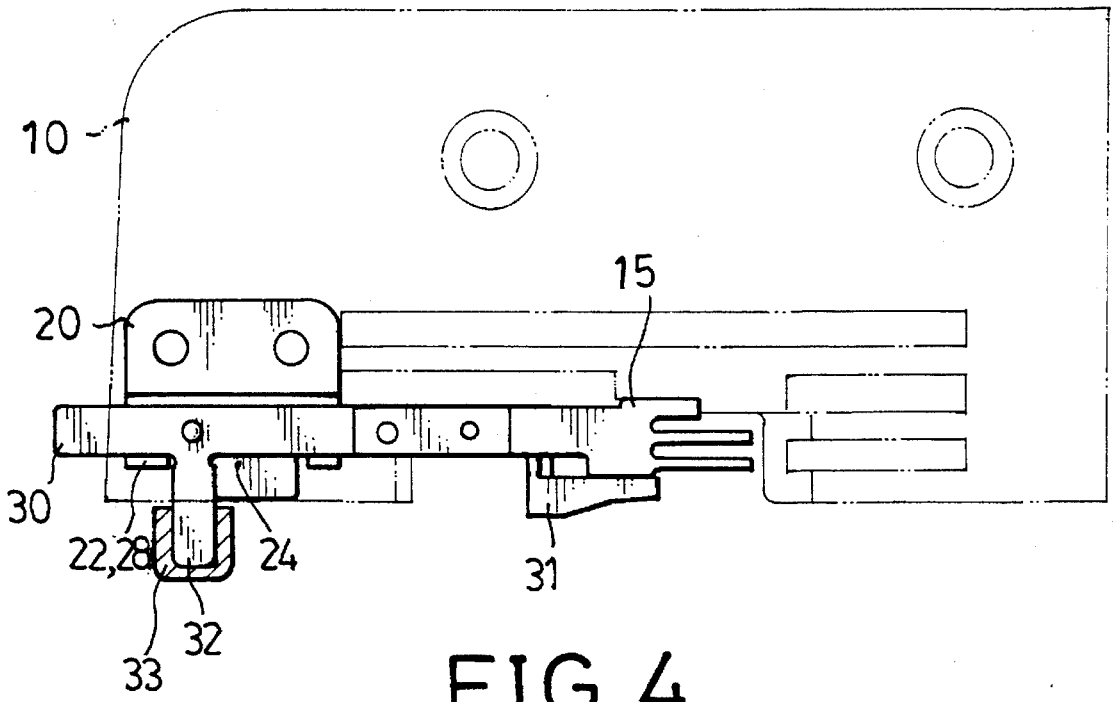
FIGS. 4 and 5 are top plane views illustrating the operation of the needle plate assembly.

Referring next to FIGS. 2 to 4, the needle plate assembly comprises a plate body 10 including one side edge 11 having an opening 12 formed therein and including an extension 14 extended inward of the opening 12. One or more fixed tongues 15 each is fixed to the extension 14 by screws 16. The tongues 15 each includes a different size, for example, 2 mm, 3 mm, 4 mm etc. Either of the tongues 15 may be secured to the plate body 10 for conducting sewing operations of different hem. A block 17 is fixed to the bottom portion of the plate body 10.

A bracket 20 is fixed to the block 17 by screws 21 and includes a U-shaped channel 22 formed therein. A depression 23 is formed in the middle portion of the channel 22 for receiving the middle portion 26 of a V-shaped spring element 25. The channel 22 includes one side wall 28 having a notch 24 formed in the middle portion thereof. A lever 30 is slidably engaged in the channel 22 and includes a slidable tongue 31 movable to the position located beside the fixed tongue 15 (FIG. 5) so as to form a regular hem. The slidable tongue 31 may also be moved away from the fixed tongue 15 (FIG. 4) such that only the fixed tongue 15 cooperates with the needles 91 for conducting sewing operations. The lever 30 includes a projection 32 laterally extended outward therefrom and extended through the notch 24, and a knob 33 secured to the projection 32.

Figure 5:
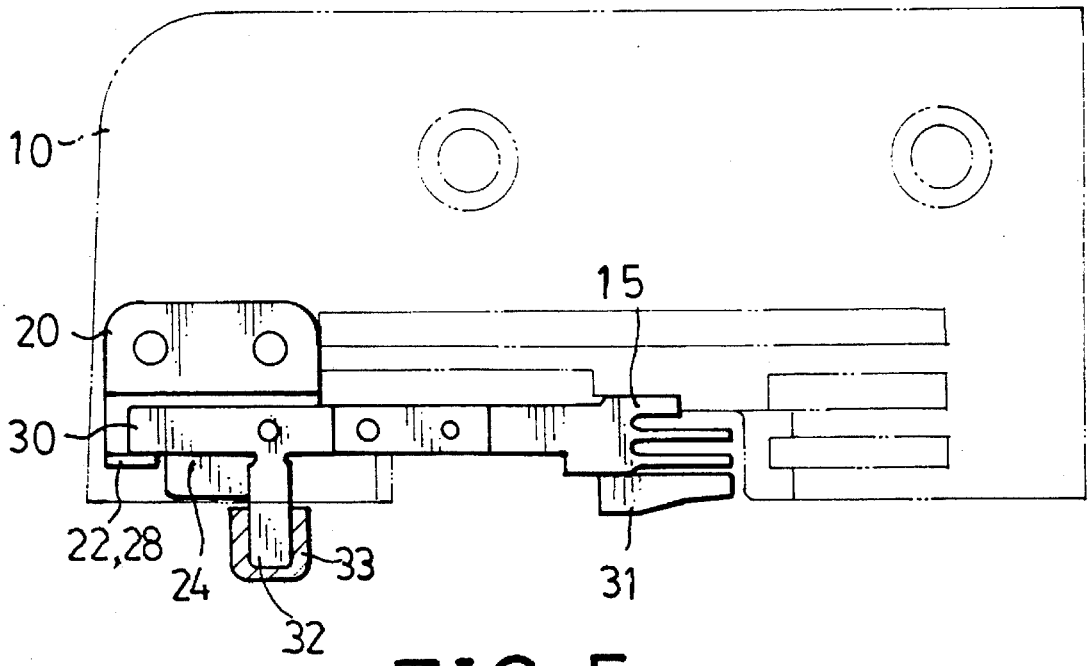

In operation, as shown in FIGS. 4 and 5, it is only required to move the slide 30 with the knob 33 such that the slidable tongue 31 may be moved either toward or away from the fixed tongue 15, such that at least two different tongues may be formed without disengaging anything from the needle plate body 10. Furthermore, when it is required to conducting other sewing operations, it is only required to change the fixed tongues 15 without disengaging the whole needle plate body 10.

Accordingly, the needle plate assembly in accordance with the present invention includes a slidable tongue movable to engage with the fixed tongue so as to form another tongue. The needle plate assembly also includes a number of tongues that may be easily secured to the needle plates without disengaging the whole needle plates from the sewing machine.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A needle plate assembly for a sewing machine comprising:

a needle plate including an opening formed therein and including at least one first tongue and including a bottom portion, a bracket secured to said bottom portion of said needle plate and including a channel provided therein, said bracket including a biasing means for biasing said lever toward said bottom portion of said needle plate and for resiliently retaining said lever in place relative to said needle plate, and a lever slidably engaged in said channel and including a first end having a second tongue formed thereon, said second tongue being moved to a position located beside said first tongue so as to form another tongue.

2. A needle plate assembly according to claim 1, wherein said channel includes a side wall having a notch formed therein, said lever includes a projection extended outward through said notch for moving said lever and for moving said second tongue toward or away from said first tongue.

3. A needle plate assembly according to claim 1, wherein said channel includes a depression formed therein, said biasing means includes a V-shaped spring having a middle portion engaged in said depression, said spring biases said lever toward said bottom portion of said needle plate for resiliently retaining said lever in place.

4. A needle plate assembly according to claim 1 further comprising means for securing said first tongue to said needle plate.

5. A needle plate assembly for a sewing machine comprising:

a needle plate including an opening formed therein and including a bottom portion, at least two first tongues, and means for securing least one of said first tongues to said needle plate and adapted to secure the other of said first tongues to said needle plate, a bracket secured to said bottom portion of said needle plate and including a channel provided therein, and a lever slidably engaged in said channel and including a first end having a second tongue formed thereon, said second tongue being moved to a position located beside said first tongue so as to form another tongue, said bracket including a biasing means for biasing said lever toward said bottom portion of said needle plate and for resiliently retaining said lever in place relative to said needle plate.

6. A needle plate assembly according to claim 5, wherein said channel includes a side wall having a notch formed therein, said lever includes a projection extended outward through said notch for moving said lever and for moving said second tongue toward or away from said first tongue.

7. A needle plate assembly according to claim 5, wherein said channel includes a depression formed therein, said biasing means includes a V-shaped spring having a middle portion engaged in said depression, said spring biases said lever toward said bottom portion of said needle plate for resiliently retaining said lever in place.

* * * * *